US005881931A

United States Patent [19]

Stanfield

[11] Patent Number: 5,881,931

[45] Date of Patent: Mar. 16, 1999

[54] HANGER FOR APPAREL

[76] Inventor: John Stanfield, 425 Riverhill Dr., Atlanta, Ga. 30328

[21] Appl. No.: 900,851

[22] Filed: Jul. 25, 1997

[51] Int. Cl.[6] ..... A47G 25/14; A47G 25/74

[52] U.S. Cl. ..... 223/85; 223/DIG. 1

[58] Field of Search ..... 223/87, DIG. 1, 223/DIG. 4, 85

[56] References Cited

U.S. PATENT DOCUMENTS

| | | | |
|---|---|---|---|
| 2,034,859 | 3/1936 | Cahn et al. | 223/87 |
| 2,057,045 | 10/1936 | Moore | 223/87 |
| 2,150,869 | 3/1939 | Shafarman | 223/88 |
| 2,172,587 | 9/1939 | Lagaard | 223/87 |
| 2,741,408 | 4/1956 | Brokenshire | 223/88 |
| 2,793,762 | 5/1957 | Broussard | 223/DIG. 1 |
| 3,268,088 | 8/1966 | Lawhorn | 211/113 |
| 4,000,768 | 1/1977 | Siegel | 223/87 |
| 4,368,823 | 1/1983 | Beckwith | 211/113 |
| 4,632,285 | 12/1986 | Dillingham | 223/88 |
| 4,811,852 | 3/1989 | Kelly | 211/119 |
| 4,863,043 | 9/1989 | Baven | 223/DIG. 1 |
| 5,480,075 | 1/1996 | Robinson | 223/88 |
| 5,526,968 | 6/1996 | Larson | 223/88 |

*Primary Examiner*—Bibhu Mohanty
*Attorney, Agent, or Firm*—Kennedy,Davis & Kennedy,PC

[57] ABSTRACT

An apparel hanger has an inverted V-shaped, flat shoulder bar to its apex of which a hook is mounted. The hook also has an inverted V-shaped, flat hook bar located above the flat shoulder bar. The shoulder bar has a spine from which rows of rib supports laterally project over which neckties may be draped. The spacing between some of the rib supports is of a size to hold two lengths of doubled over belts with the belt bights supported thereabove.

1 Claim, 2 Drawing Sheets

HANGER FOR APPAREL

TECHNICAL FIELD

This invention relates to hangers used in hanging apparel for storage or display, and particularly to hangers used in hanging neckties and belts.

BACKGROUND OF THE INVENTION

Hangers have long been used in supporting apparel for storage and display. They commonly have an upper hook of a size and shape to be hooked over a cylindrical support bar along with others in side by side relation. Typically, the hangers have a support rod located below and in the plane of the hook and an inverted V-shaped shoulder bar that supports each end of the support rod below the hook to the apex of which the hook is mounted. So constructed, the support rod is suspended horizontally beneath the hook once it is hooked over an ancillary cylindrical support bar such as those mounted in clothes closets or on display racks. Shirts and jackets may then be draped over shoulder bar and pants draped over the hanger rod.

Hangers have also been designed and used in supporting neckties. Exemplary of these specialty type hangers are those shown in U.S. Pat. Nos. 2,150,869; 3,268,088; 4,368,823; 4,632,285; 4,811,852 and 5,526,968. These designs have in general failed to obtain acceptance. Their lack of success can be attributable to the complexity and cost of some of their constructions. Others have failed to suspend a number of neckties spaced from each other such that they are both readily viewable, mountable and retrievable. For example, neckties are actually draped one upon the other in stacks in the hangers of the U.S. Pat. Nos. 4,632,285 and 4,811,852 patents. With most the neckties are suspended generally along the plane of the hanger hook and support structure such they do not face outwards from the ancillary hanger support bar but rather at 90° to such. This restricts their view such that one in browsing for a necktie must cock his head or twist the hanger. Other tie holders have a series of pegs mounted on a board or on a circular support that is mounted to a wall.

Another problem in common with hangers is their instability. Most of their hooks are curved to match the curvature of the support rod from which they are hooked. This enables them to rotate freely and thus to tilt to one side or the other when their necktie load is uneven. This is aggravated where the curvature of the hook fails to match that of the cylindrical bar. Indeed, this often happens since the curvature of the hook must be large to be able to be hooked on bars of various sizes. Due to their shape they are ill suited for use in confined spaces. Their constructions have also been directed primarily at the support of neckties rather than belts. Thus when belts are draped over their support rod, belts being made of stronger and less flexible material than soft neckties, they have bulged substantially outwardly and tended to fall off easily what with one of their ends usually having a heavier buckle component than their opposite end.

Accordingly, it is seen that if an apparel hanger could be devised that tended to ameliorate these problems long associated with apparel hangers, a distinct advantage could be achieved. It is to the provision of such that this invention is primarily directed.

SUMMARY OF THE INVENTION

Briefly described, the apparel hanger comprises a generally inverted V-shaped, flat shoulder bar to its apex of which a hook is mounted. The hook also has a generally inverted V-shaped, flat bottom located above the shoulder bar. The shoulder bar has a spine from the sides of which rows of rib supports laterally project over which neckties may be draped in spaced, side by side relation. The shoulder bar may also have two of its rib supports located sufficiently close together to provide a slot therebetween sized to receive and hold two portions of a belt that is doubled over upon itself with the belt bight held thereabove.

DETAILED DESCRIPTION

Figure 1:
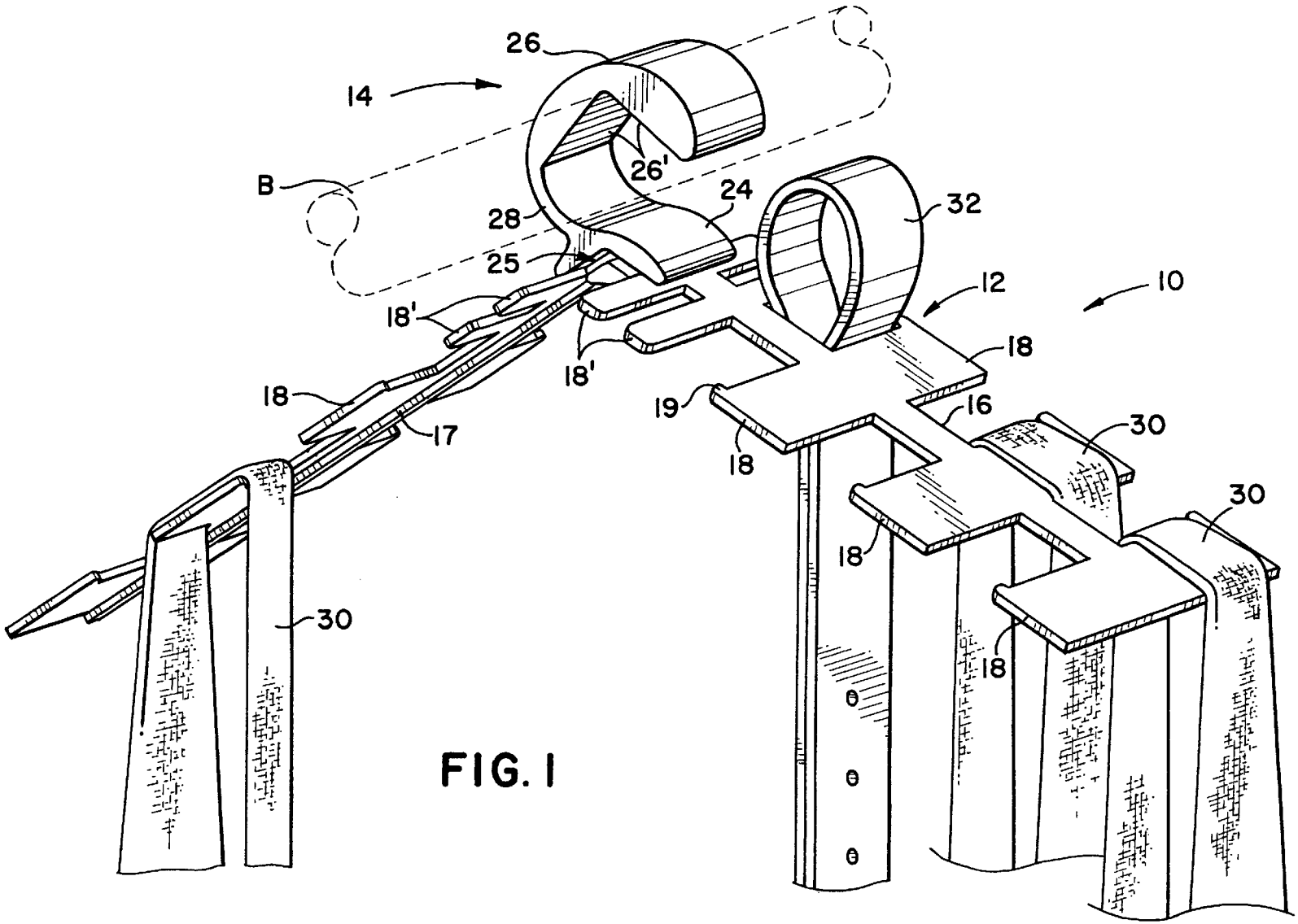
FIG. 1 is a perspective view of a preferred embodiment of the apparel hanger shown supporting three neckties and a belt.
Figure 2:
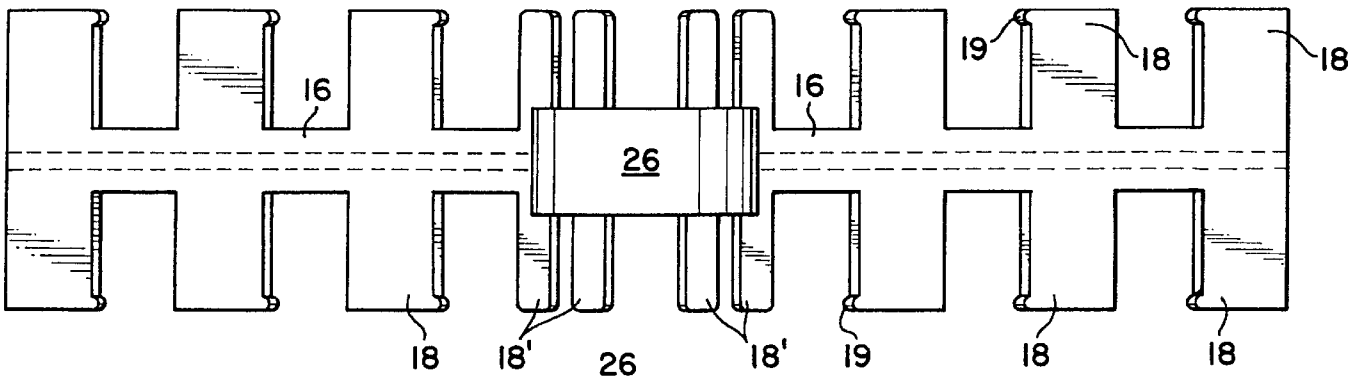
FIG. 2 is a top view of the hanger shown in FIG. 1.

With reference in more detail to the drawing, there is shown an apparel hanger 10 that has an inverted V-shaped, flat shoulder bar 12. The bar is preferably made of plastic by injection molding and then bent to shape. The bend in its inverted V-shaped orientation is maintained by the mounting of a hook 14 to the apex of the shoulder bar located midway between its ends, as later explained.

The shoulder of the hanger bar 12 has a spine 16 from opposite sides of which flat rib supports 18 laterally project in spaced, side by side relation. Each rib support is formed with a small catch 19 at its end distal the spine 16. Collectively the rib supports form two stair-step rows that extend laterally both to opposite sides of the spine and to opposite sides of the apex 22 of the shoulder bar.

Two pairs of the flat rib supports 18' that are located adjacent to and straddling the apex 22 are seen to be spaced apart a distance less than the other rib supports 18 located further away from the apex. These are for holding belts instead of neckties, as also later explained, although they may be used to support neckties too.

The hook 14 is also preferably made of plastic and is designed to be removably mounted to the apex 22 of the shoulder bar 12. The hook 14 is seen to have a base 24 that has an inverted V-shaped slot 25 sized to receive and snugly hold the apex 22 portion of the shoulder bar 12 by an unshown dimple type detent. One end of the slot is open to receive the shoulder bar in tongue and groove fashion. The hook also has a dome 26 located directly over the base 24. The two legs 26' of the dome collectively form an inverted V-shape dome bottom with each of their bottom surfaces being flat. A curved bar 28 extends from the hook base 24 to one end of one of the two legs 26' that form the dome. With this construction the hook may be readily mounted to the shoulder bar by bending its midpoint, along an unshown score line, and sliding it into the base slot and in doing so maintains the shoulder bar in its now bent configuration.

Figure 3:
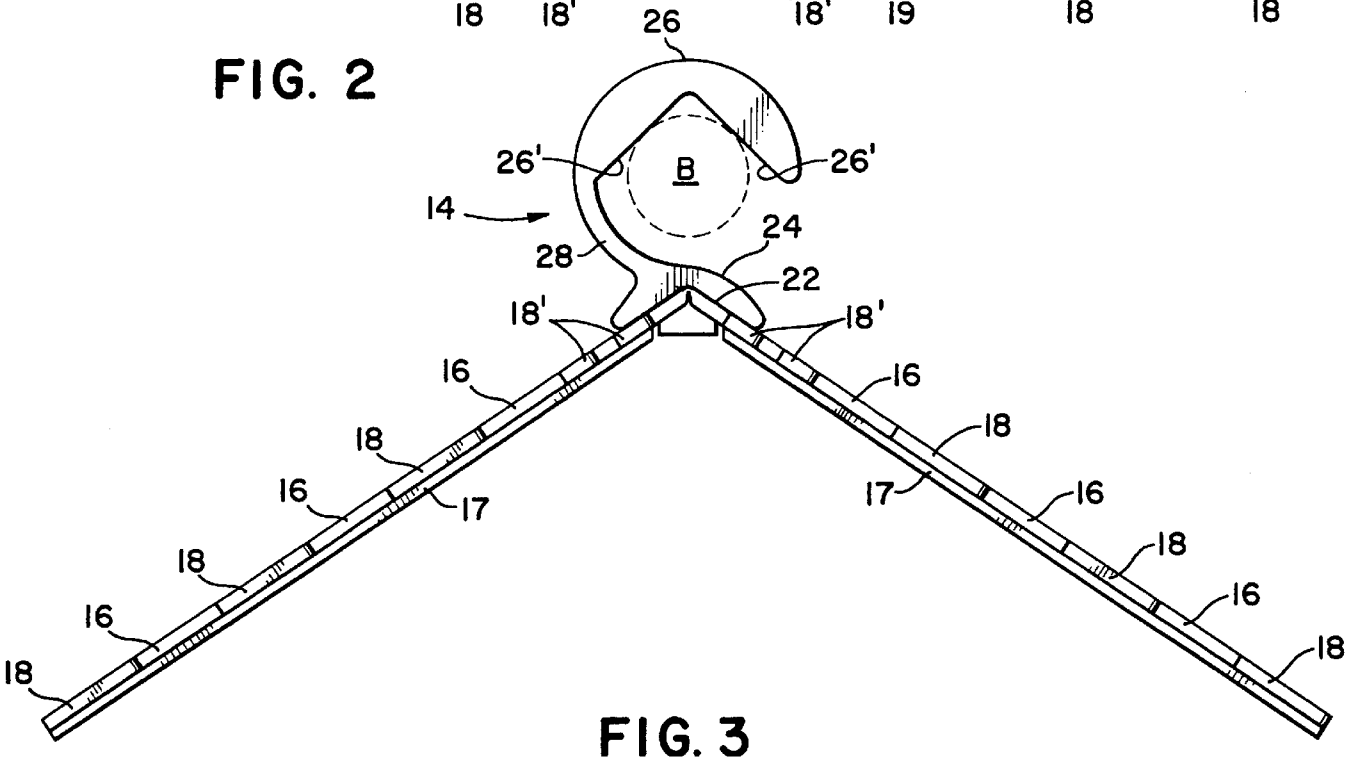
FIG. 3 is a side view of the hanger shown in FIG. 1.

In use the hanger may be securely mounted to an ancillary bar B that is shown in broken lines in FIGS. 1 and 3. In doing so it is seen that the inside of the hook dome 26 contacts the bar B along two lines of contact lines that extend the entire width of the dome. This serves to render the hanger quite stable once mounted. Furthermore, this stability is maintained even with the hook hooked over bars B of various diameters since two lines of point contact, though radially shifted, are still present regardless of the size of the ancillary support bar B.

Apparel may be mounted as shown. In FIG. 1 three neckties 30 are shown draped over three of the rib supports

18 with their principal surfaces held parallel with the bar B. This enhances their viewability since one ordinarily faces the bar B in selecting, dismounting and in remounting neckties. That the rib supports are stair-stepped also enhances their viewability. A belt 32 is also shown in FIG. 1 to be mounted to the hanger. This is done simply by doubling it over upon itself and sliding it into a slot between two of the rib supports 18 with its bight now held above the shoulder bar where it is easily seen for selection and gripping. Alternatively belts may be hung by their buckles from the smaller rib supports 18'.

It thus is seen that an apparel hanger is now provided that possesses a number of distinct attributes. While it has been shown and described in its preferred embodiment, it should be understood that many changes, additions and deletions may be made thereto without departure from the spirit and scope of the invention as set forth in the following claims.

I claim:

1. A hanger for apparel comprising a generally inverted V-shaped flat shoulder bar having a mid-portion at its apex to which a hook is removably mounted that has a base that defines an inverted V-shaped groove sized and shaped to be removably mounted to said shoulder bar mid portion in tongue and groove fashion, and wherein said shoulder bar has a spine from at least one side of which a row of ribs laterally projects over which neckties and the like may be draped in spaced side-by-side relation.

* * * * *